US007938734B2

(12) United States Patent
Dsouza

(10) Patent No.: US 7,938,734 B2
(45) Date of Patent: May 10, 2011

(54) PRACTICE PLATFORM FOR GOLFER

(76) Inventor: Cyril R. Dsouza, Lethbridge (CA)

( * ) Notice: Subject to any disclaimer, the term of this patent is extended or adjusted under 35 U.S.C. 154(b) by 0 days.

(21) Appl. No.: 12/562,550

(22) Filed: Sep. 18, 2009

(65) Prior Publication Data

US 2011/0070966 A1 Mar. 24, 2011

(51) Int. Cl.
*A63B 69/36* (2006.01)

(52) U.S. Cl. ..... 473/279; 473/161; 473/278

(58) Field of Classification Search ..... 473/160, 473/161, 278, 279
See application file for complete search history.

(56) References Cited

U.S. PATENT DOCUMENTS

| | | | | |
|---|---|---|---|---|
| 3,869,127 | A * | 3/1975 | Kohori | 473/279 |
| 5,005,837 | A * | 4/1991 | Urra Martinez | 473/279 |
| 5,358,251 | A * | 10/1994 | Ashton | 473/269 |
| 5,820,478 | A * | 10/1998 | Wood et al. | 473/279 |
| 2004/0110570 | A1 * | 6/2004 | Hutchon et al. | 473/161 |

* cited by examiner

*Primary Examiner* — Nini Legesse
(74) *Attorney, Agent, or Firm* — The Webb Law Firm

(57) ABSTRACT

This invention relates to a practice platform for a golfer comprising a platform on a base which is provided with hinge supports at each corner to be in an inclined plane wherein a lifting mechanism is provided between said platform and base, and said platform is comprised of a slidable platform on two sides.

14 Claims, 9 Drawing Sheets

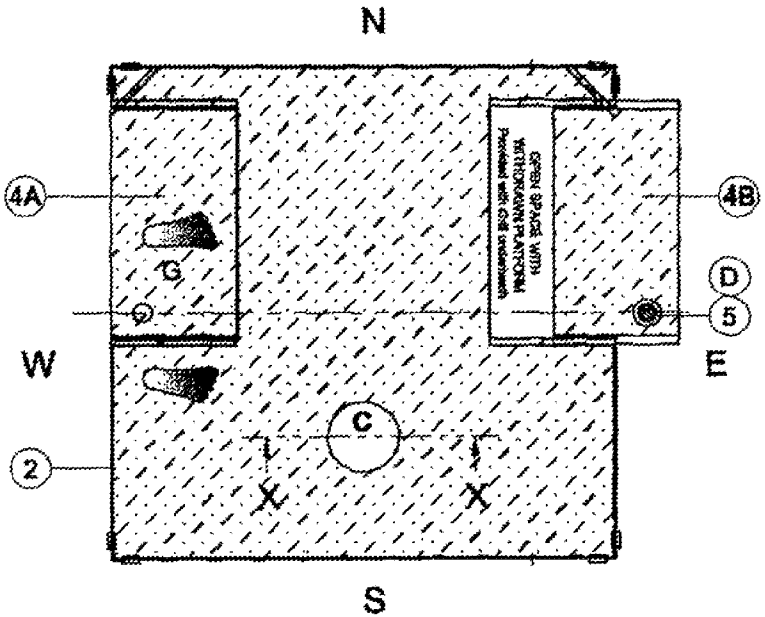
FIG-2B
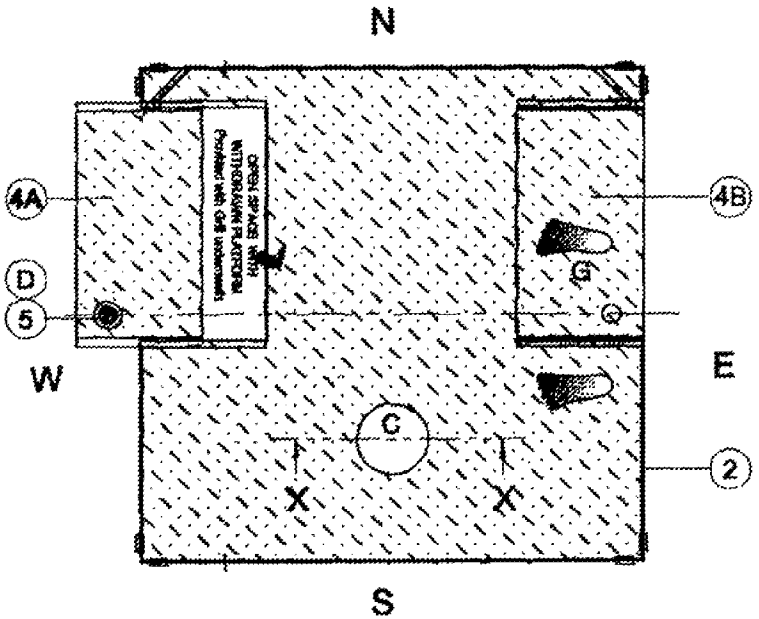
FIG-2A
FIG-2

PRACTICE PLATFORM FOR GOLFER

FIELD OF INVENTION

This invention relates to a practice platform for golfer.

BACKGROUND OF THE INVENTION

There are ample facilities to practice all the shots in repertoire except one, the shot from an 'odd' lie i.e. where the ball is required to be hit when lying above one's feet or below one's feet from a side-hill lie. The only chance, one gets to hit these shots is when the golfer is actually playing the game without a clue where the ball will end up or when the ball is lying on the edge of the fairway against the rough.

OBJECTS OF THE INVENTION

An object of the present invention is to provide a practice platform for golfer which can be positioned on the practice range on any golf course.

Another object of the present invention is to provide a practice platform for golfer which is efficient.

STATEMENT OF INVENTION

According to this invention, there is provided a practice platform for golfer comprising of a platform on a base which is provided with hinge supports at each corner to be in inclined plane wherein a lifting mechanism is provided between said platform and base, and said platform comprising of slidable platform on both sides.

BRIEF DESCRIPTION OF THE ACCOMPANYING DRAWINGS

Further objects and advantages of this invention will be more apparent from the ensuing description when read in conjunction with the accompanying drawings and wherein:

FIG. 2 shows: Plan of the present invention.

DETAILED DESCRIPTION OF THE INVENTION WITH REFERENCE TO THE ACCOMPANYING DRAWINGS

The present invention discloses a practice platform to be used at a practice range for the golfer to practice shots in unusual lies and positions. These are the positions when the golf ball is located on a down slope or an up slope and on a side hill with the ball below one's feet or above. The platform can be used by both right and left handed golfers.

Figure 1:
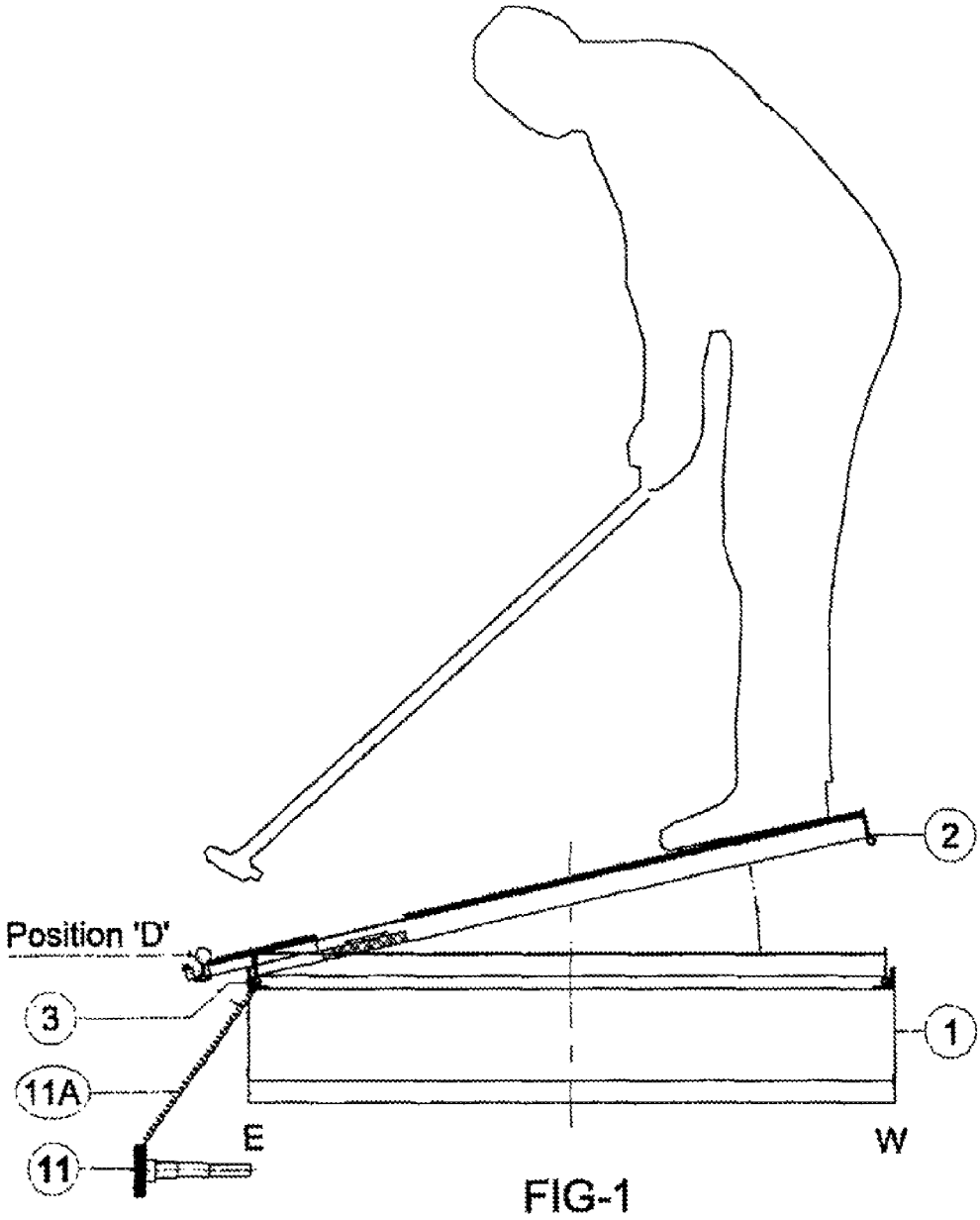
FIG. 1 shows: Front view of the present invention.

Now, reference may be made to FIG. 1 wherein a platform (2) is provided on a base (1) and with hinge supports (3) at all the corners whereby the platform can be hinged along any edge and the opposite edge can be lifted to be in inclined plane, slopping on one side.

Each side can be identified as edge 'E' (East), 'W' (West), 'N' (North) & 'S' (South) as shown in subsequent figs. The platform (2) can be kept in horizontal plane or in inclined plane in any direction viz. E to W, W to E, N to S or S to N.

Figure 9:
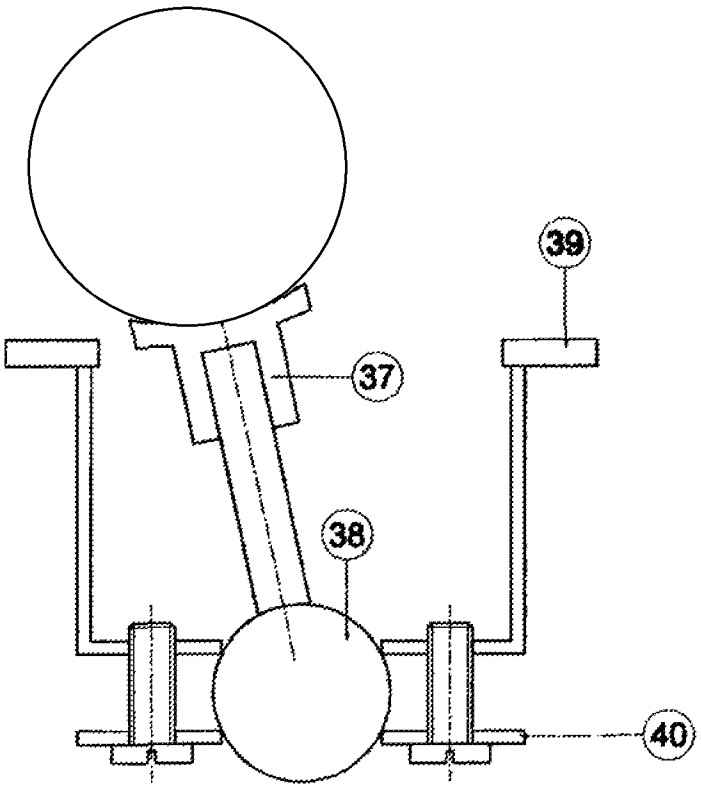
FIG. 9 shows: Ball resting peg.

Now, referring to FIGS. 2 (2A & 2B) in which two separate golf ball platform (4A) & (4B) for right and left handed golfers for keeping golf ball (5) are located on opposite edges of a golf platform (2) opposite to each other. Each platform (4A & 4B) is provided with a hole for accommodating golf ball resting peg holder (39) (As shown in FIG. 9).

In FIG. 2A, platform (4A) is shown in pulled out position and platform (4B) is shown in pushed in position for practicing by right handed golfer wherein the golfer stands at position (G). In FIG. 2-B, the platform (4B) is shown in pulled out position and platform (4A) is shown in pushed in position for practicing by left handed golfer wherein the golfer stands at position (G).

Further, the golf platform (2) has a hole at location marked by 'C' so as to keep basket of golf balls.

Now, reference may be made to FIG. 1, wherein the base (1) is manufactured for ex. from rolled steel sections for required rigidity, stability & light weight. It can also be manufactured from solid plates of light metals or sheet metal or wooden planks or even fibre glass. It can be a totally closed box or open hollow structure in construction. It can also be manufactured either as a fully & permanently welded or screwed integral parts or with a plurality of detachable parts which can be assembled to make one integral part.

Figure 3:
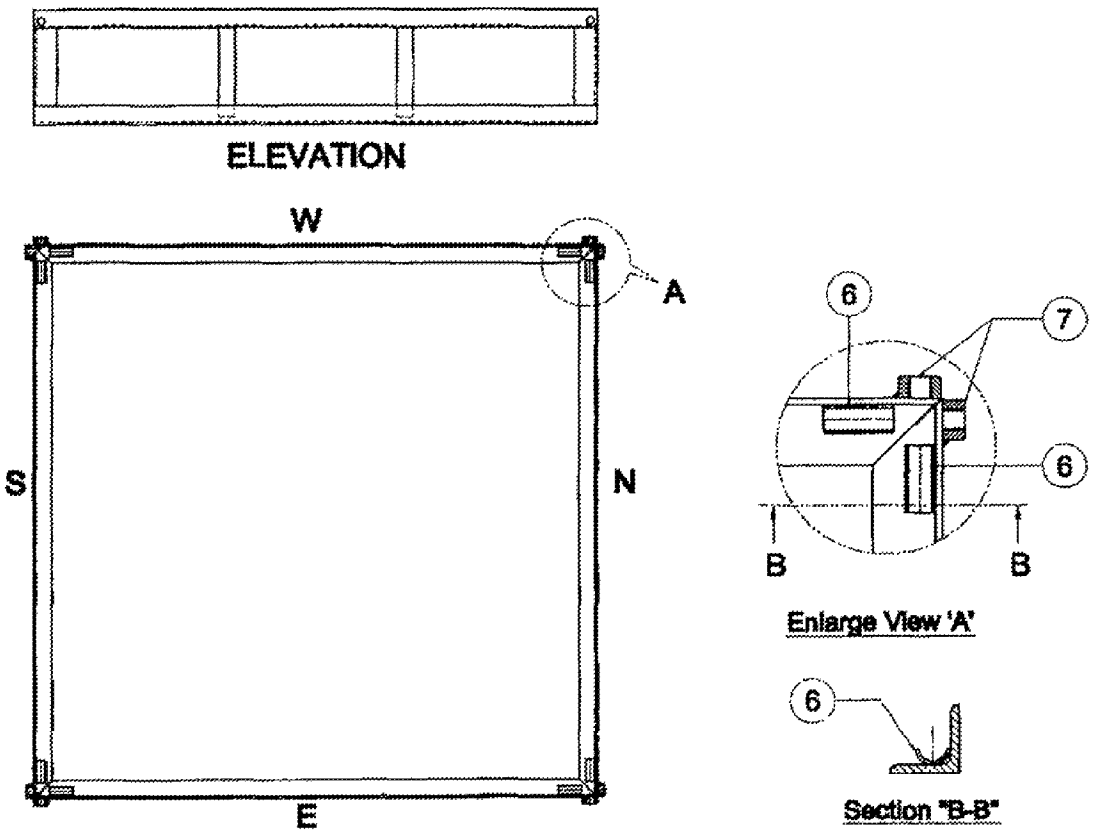
FIG. 3 shows: Base of the present invention, and enlarged and sectional view of its corner.

The base (1) is provided with a plurality of half round guides (6) & pad for hinge pin (7), at least two at each corner, each placed on adjacent edges as shown in FIG. 3, enlarged view 'A' and section 'B-B'.

Figure 4:
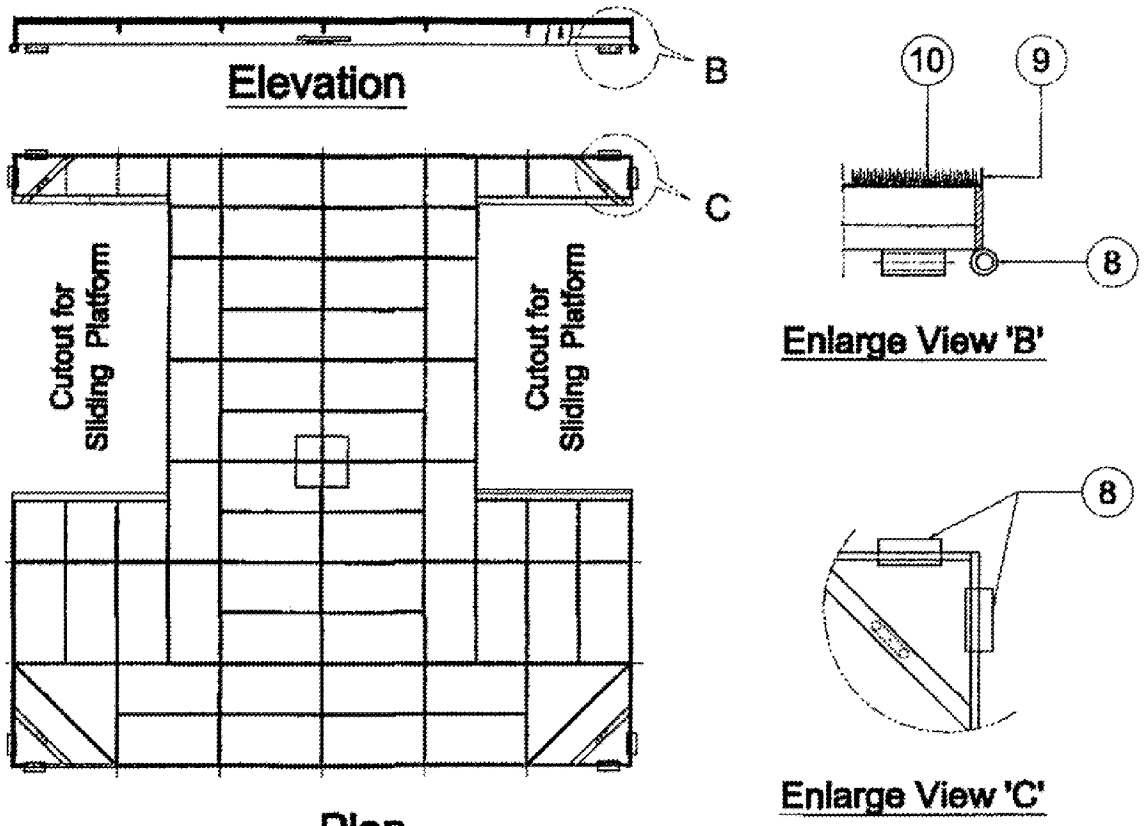
FIG. 4 shows: Plan and Elevation of platform with enlarged view of its corner.

The platform (2) as shown in FIG. 4 is manufactured such as from roll steel sections with grilled construction for light weight. It can also be manufactured from sheet metal, light metal plates, reinforced plastic or wooden planks. The platform has a plurality of round locators at least two at each corner, each one placed on adjacent edges as shown in partial enlarged view 'B' of elevation & partial enlarged view 'C' of plan. Said platform (2) is provided with a top cover (9) so as to support Astroturf (10).

The platform (2) rests on the base (1) with locators (8) resting on guides (6). For sloping the platform (2) with respect to any one edge as desired, it is hinged with hinge pins (11) (shown in FIG. 1) provided at each corner. Said hinge pins (11) are attached to the base (1) at corners with flexible link chain (11A).

The golf platform in (2) is provided with cut-out at opposite (E & W) edges to accommodate golf ball platforms (4A & 4B) with channel guide.

Figure 5:
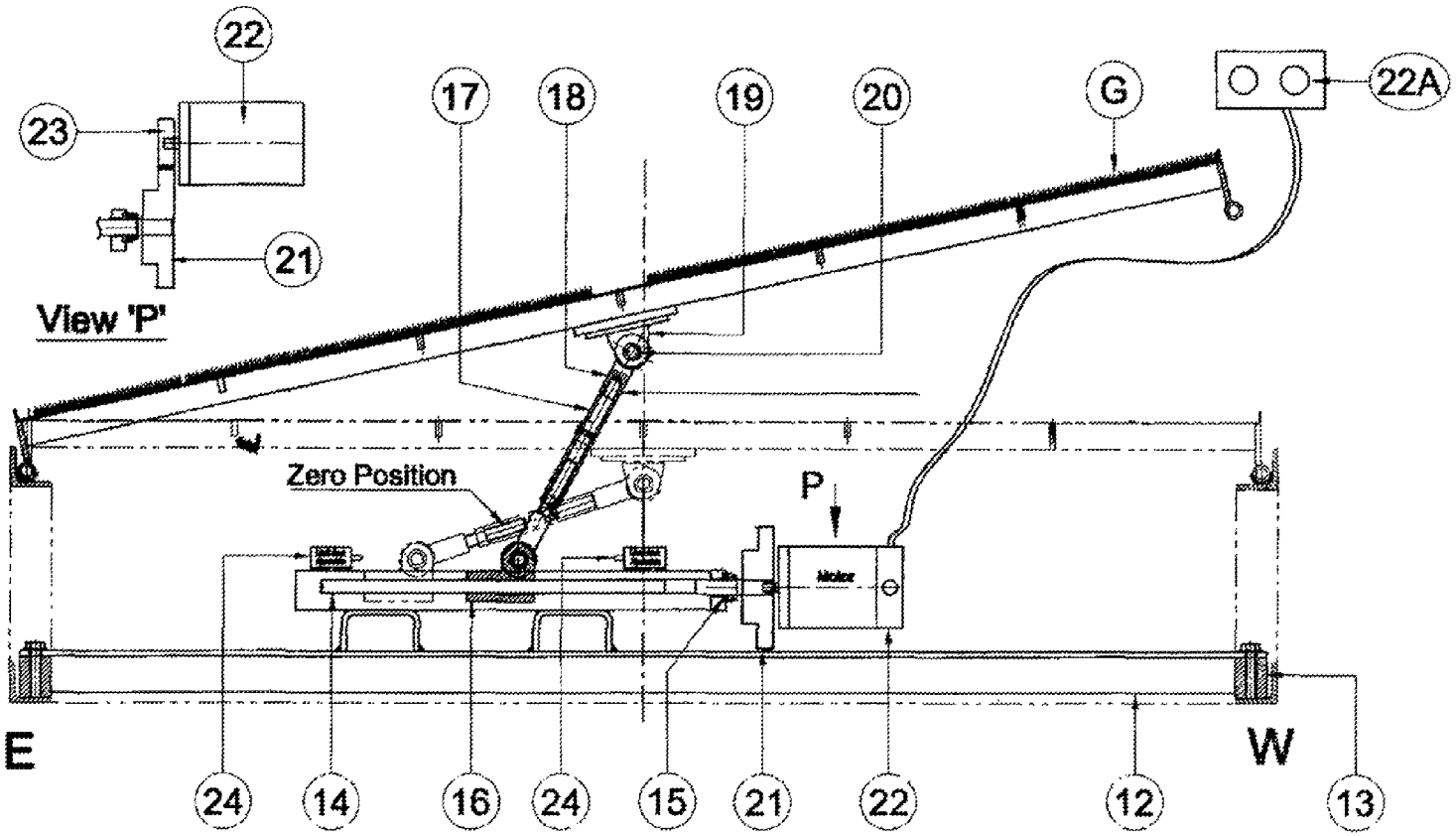
FIG. 5 shows: Lifting mechanism of the present invention.

Now, reference may be made to FIG. 5 wherein with the help of the lifting mechanism when one edge of the platform (2) is hinged, the opposite edge can be raised to desired inclination.

The lifting mechanism comprising of a beam (12) supported at ends on to the base (1) with distance pieces (13). It is provided with a threaded screw (14) supported on bearing (15) at one end and a sliding nut (16). A connecting rod (17) has ball socket type rod ends (18) at both ends and is connected to sliding nut (16) at one end and a platform (2) at other end through a hinge bracket (19) through hinge pins (20). The hinge bracket (19) is connected to the platform (2).

A gear (21) is fixedly provided onto the threaded screw (14) at one end. An electric motor (22) is also provided having a gear (23) which engages with gear (21) as shown in view 'P'. With the rotation of the motor (22) either in forward or reverse direction, the threaded screw (14) rotates in either forward or reverse direction and also, a sliding nut (16) moves forward or backwards and lifts or lowers the platform (2).

As shown in the FIG. 5, the platform is in horizontal plane termed as zero position and also in lifted position. The lift of a platform can be controlled by restricting the movement of sliding nut (16) with electrical limit switches (21), one at zero position and other set at lifted position of platform (2) by stopping rotation of electric motor (22).

A hand held pendant (22A) with electrical switches for lifting or lowering is provided with flexible cables for a golfer to adjust and control the inclination of golf platform (2).

Figure 6:
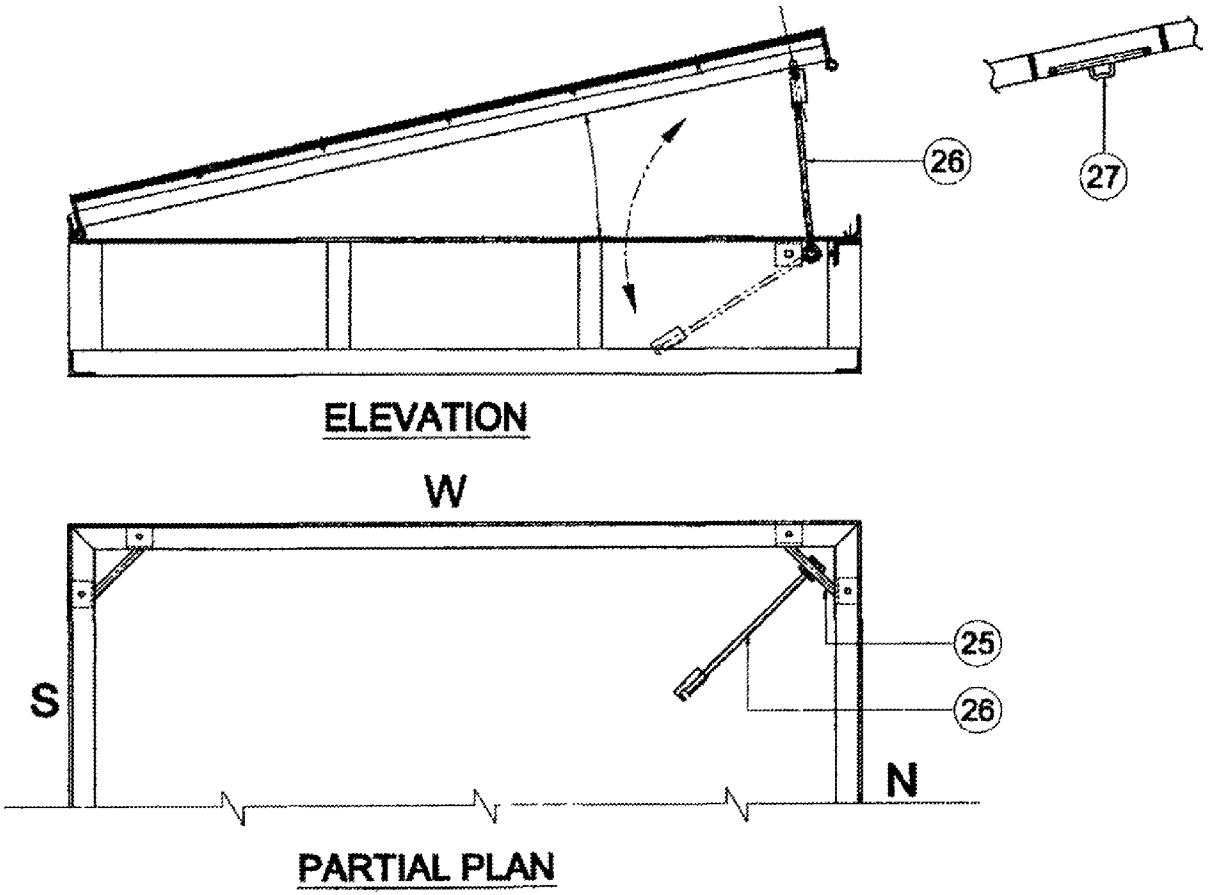
FIG. 6 shows: Plan of base and elevation of the present invention.

FIG. 6 shows the support system for golf platform in raised position.

When the platform (2) is in inclined position with one edge hinged, the opposite edge in lifted position is supported at the corners for rigid and stable support for golfer.

In FIG. 6, the base (1) is shown partially cut in plan provided with a hinge rod bracket (25) screwed to the base at all the four corners with preassembled hook rod (26). In the elevation, the base (1) and the platform (2) are in inclined position. The platform (2) has inverted 'C' shaped support eye (27) attached to it from bottom side. When the platform edge is raised, a hood rod (26) can be hooked into said support eye (27). When the platform (2) is required to be lowered the hood rod (26) is disengaged.

Figure 7:
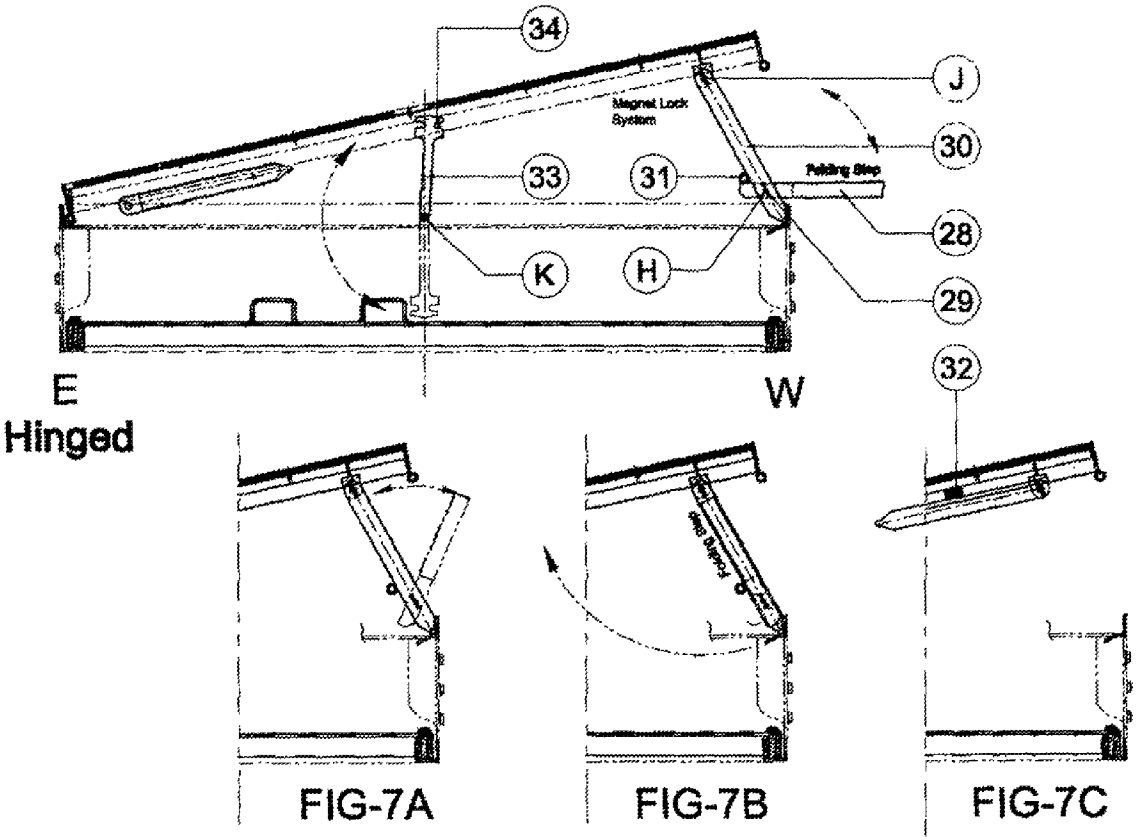
FIG. 7 shows: Folding steps of the present invention.

FIG. 7 shows the center supports for the raised edge of the golf platform (2) and also a provision of folding step for golfer to climb on to the platform (2).

Folding steps are provided on both 'E' and 'W' edges. Either of the folding steps can be unfolded as per the requirement.

The FIG. 7 shows the assembly in folded condition on edge 'E' and with unfolded step on edge 'W'.

A folding step (28) is hinged at location 'H' with hinge rod (29) to at least two parallel levers (30) connected to each other with a rod (31) and hinged at location 'J' to golf platform (2). When the platform is in inclined position, said levers rest on the base and the folding step (28) is horizontal being stopped with connecting rod (31).

When the golf platform (2) is required to be lowered, the folding step (28) is rotated (as shown in FIG. 7A) and brought to the plane of levers (30). It is also held in position with magnetic lock (as shown in FIG. 7B).

The combined assembly of folding step (28) with parallel levers (30) is folded beneath the golf platform (2) and held in position with magnetic lock (32) (as shown in FIG. 7C).

The golf platform (2) is also supported in the center of edge 'S' and 'N'. Further, a lever (33) with slot on either side is hinged on base at location and a pin (34) is provided on said golf platform (2). When the golf platform (2) is raised, the lever (33) is engaged with pin (34) thereby supporting the golf platform (2).

For lowering the platform, the lever (33) is disengaged and allowed to remain freely hanging with base.

Figure 8:
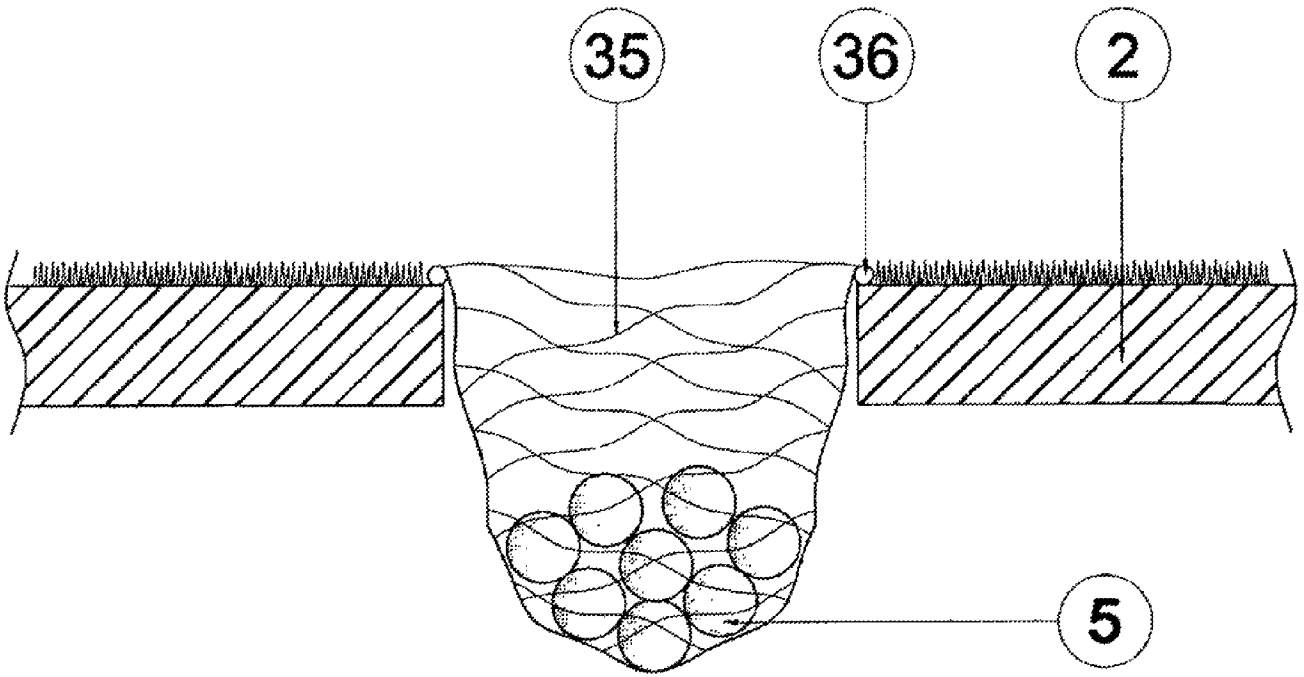
FIG. 8 shows: Cross sectional view of platform through a hole at 'C'.

FIG. 8 shows the golf platform (2) in partial cross section through a hole at location 'C' shown in FIG. 2. A wire netted flexible basket (35) with a support ring (36) is positioned through the hole for holding golf balls (5).

FIG. 9 shows ball resting peg (37) with toggle systems to ensure a horizontal leveled surface for golf ball even when the golf platform (2) is inclined.

The golf ball peg (37) is provided with a ball end (38) which is clamped between a holder (39) and clamping sheet (40).

The golf ball peg (37) can be swiveled in any direction.

The holder (39) is duly assembled with peg (37) and clamping sheet (40) as a whole assembly is positioned into the hole provided on sliding platform (4A & 4B) at location 'D'.

It is to be noted that the present invention is susceptible to modifications, adaptations and changes by those skilled in the art. Such variant embodiments employing the concepts and features of this invention are intended to be within the scope of the present invention, which is further set forth under the following claims:

I claim:

1. A practice platform for a golfer comprising: a platform on a base which is provided with hinge supports at corners of the platform to be in an inclined plane wherein a lifting mechanism is provided between said platform and base, and said platform comprising a slidable platform on two sides.

2. The practice platform for a golfer as claimed in claim 1, wherein said slidable platforms comprise at least one platform for the golfer to stand thereon and another platform for accommodating a golf ball resting peg holder.

3. The practice platform for a golfer as claimed in claim 2, wherein said golf ball resting peg holder comprises a golf ball peg provided with a ball end clamped between a holder and a clamping sheet in which said peg can be swiveled in any direction.

4. The practice platform for a golfer as claimed in claim 1, wherein said base is provided with at least two half round guides and at least two pads for hinge pins at corners of the base on adjacent edges.

5. The practice platform for a golfer as claimed in claim 1, wherein said platform is provided with at least two round locators at each corner of the platform resting on said half round guides.

6. The practice platform for a golfer as claimed in claim 1, wherein said platform has a top cover to support astroturf and is provided with a hole to accommodate a basket of golf balls.

7. The practice platform for a golfer as claimed in claim 1, wherein said lifting mechanism comprises a beam supported at ends onto the base by distance pieces.

8. The practice platform for a golfer as claimed in claim 1, wherein said mechanism is provided with a connecting rod having ball socket type rod ends and is connected to a sliding nut at one end and the platform at another end.

9. The practice platform for a golfer as claimed in claim 1, wherein said mechanism comprises a sliding nut, which moves forward or backwards and lifts or lowers the platform with the help of a motor.

10. The practice platform for a golfer as claimed in claim 1, wherein lift of said platform can be controlled by controlling the movement of said sliding nut with electrical limit switches, one switch set at a zero position and another switch set at a lifted position of the platform.

11. The practice platform for a golfer as claimed in claim 1, wherein said base has a hinge rod bracket in connection with a hook rod.

12. The practice platform for a golfer as claimed in claim 1, further comprising a hand held pendant with electrical switches for adjusting and controlling the inclination of said golf platform.

13. The practice platform for a golfer as claimed in claim 1, wherein said platform has an inverted support eye attached to it from a bottom side of the platform.

14. The practice platform for a golfer as claimed in claim 1, further comprising center supports for the raised edge of the golf platform and folding steps to climb on to the platform.

* * * * *